US011189913B2

(12) United States Patent
Chen et al.

(10) Patent No.: US 11,189,913 B2
(45) **Date of Patent: *Nov. 30, 2021**

(54) ANTENNA STRUCTURE FOR EXTENDED DISTANCE RADAR FUNCTION AND ELECTRONIC DEVICE USING THE SAME

(71) Applicant: Shenzhen Next Generation Communications Limited, Shenzhen (CN)

(72) Inventors: Kuo-Cheng Chen, New Taipei (TW); Yi-Ming Chen, New Taipei (TW); Siang-Yu Siao, New Taipei (TW); Zheng Lin, Shenzhen (CN); Teng-Bang Hou, New Taipei (TW); Chih-Chung Hsieh, New Taipei (TW)

(73) Assignee: Mobile Drive Netherlands B.V., Amsterdam (NL)

( * ) Notice: Subject to any disclaimer, the term of this patent is extended or adjusted under 35 U.S.C. 154(b) by 138 days.

This patent is subject to a terminal disclaimer.

(21) Appl. No.: 16/523,608

(22) Filed: Jul. 26, 2019

(65) Prior Publication Data

US 2020/0036090 A1 Jan. 30, 2020

Related U.S. Application Data

(60) Provisional application No. 62/703,891, filed on Jul. 27, 2018.

(51) Int. Cl.
*H01Q 1/32* (2006.01)
*H01Q 21/00* (2006.01)
(Continued)

(52) U.S. Cl.
CPC ..... *H01Q 1/3233* (2013.01); *H01Q 1/38* (2013.01); *H01Q 1/48* (2013.01);
(Continued)

(58) Field of Classification Search
None
See application file for complete search history.

(56) References Cited

U.S. PATENT DOCUMENTS 10,454,185 B1 * 10/2019 Moran ..... G01S 3/48
2007/0080891 A1 * 4/2007 De Lustrac ..... H01Q 19/28 343/909

(Continued)

FOREIGN PATENT DOCUMENTS

CN 106972244 A 7/2017
CN 107611577 A 1/2018
CN 108196255 * 6/2018

OTHER PUBLICATIONS

Lei Duan, Research on 77GHz Microstrip Array Antenna, Dissertation for the Master's Degree in Engineering, Feb. 15, 2017, pp. 8-60.

*Primary Examiner* — Crystal L Hammond
(74) *Attorney, Agent, or Firm* — ScienBiziP, P.C.

(57) ABSTRACT

An antenna structure serving as a radar emitter with extended long range function comprises a radiating element comprised of radiating units connected in series by a feeder. Each two adjacent radiating units are spaced apart from each other by a specified distance. Lengths of the radiating units are same, and width of the radiating units gradually decreases from a center to ends. The feeder transmits a current signal to the radiating element. The radiating element emits a radar beam based on the current signal.

12 Claims, 4 Drawing Sheets

(51) Int. Cl.
*H01Q 1/48* (2006.01)
*H01Q 1/38* (2006.01)
*H01Q 21/06* (2006.01)

(52) U.S. Cl.
CPC ..... *H01Q 21/0006* (2013.01); *H01Q 21/0075* (2013.01); *H01Q 21/061* (2013.01)

(56) References Cited

U.S. PATENT DOCUMENTS

2008/0117004 A1* 5/2008 Mochizuki ..... H01P 1/203 333/204
2014/0203960 A1* 7/2014 Huang ..... H01P 5/12 342/175
2017/0040702 A1* 2/2017 West ..... H01Q 11/105

* cited by examiner

ANTENNA STRUCTURE FOR EXTENDED DISTANCE RADAR FUNCTION AND ELECTRONIC DEVICE USING THE SAME

FIELD

The subject matter herein generally relates to electronic devices with antenna structure.

BACKGROUND

Vehicle radars having 77 GHz wave frequency are unaffected by rain and fog, and have a long detecting ability (a distance such as 150-200 meters), high resolution, and small size. There are three types of vehicle radar based on different distances, namely, for long, medium, and short distances. The long distance type vehicle radar includes an antenna structure with a larger gain. Optimizing the antenna structure while improving transmission distance is problematic.

Thus, there is room for improvement in the art.

BRIEF DESCRIPTION OF THE FIGURES

Implementations of the present disclosure will be described, by way of example only, with reference to the figures.

DETAILED DESCRIPTION

Figure 1:
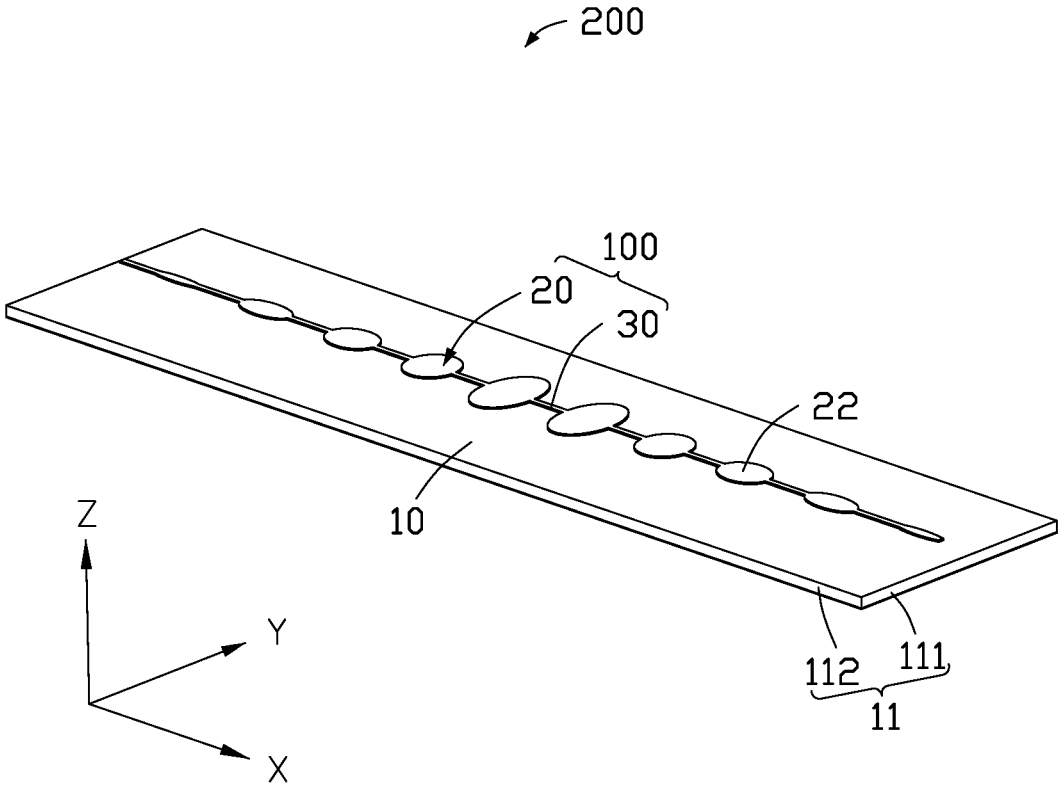
FIG. 1 is a diagram illustrating an embodiment of an antenna structure in an electronic device, the antenna structure comprises a radiating element with a plurality of radiating units.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

The present disclosure describes an electronic device with an antenna structure.

Figure 2:
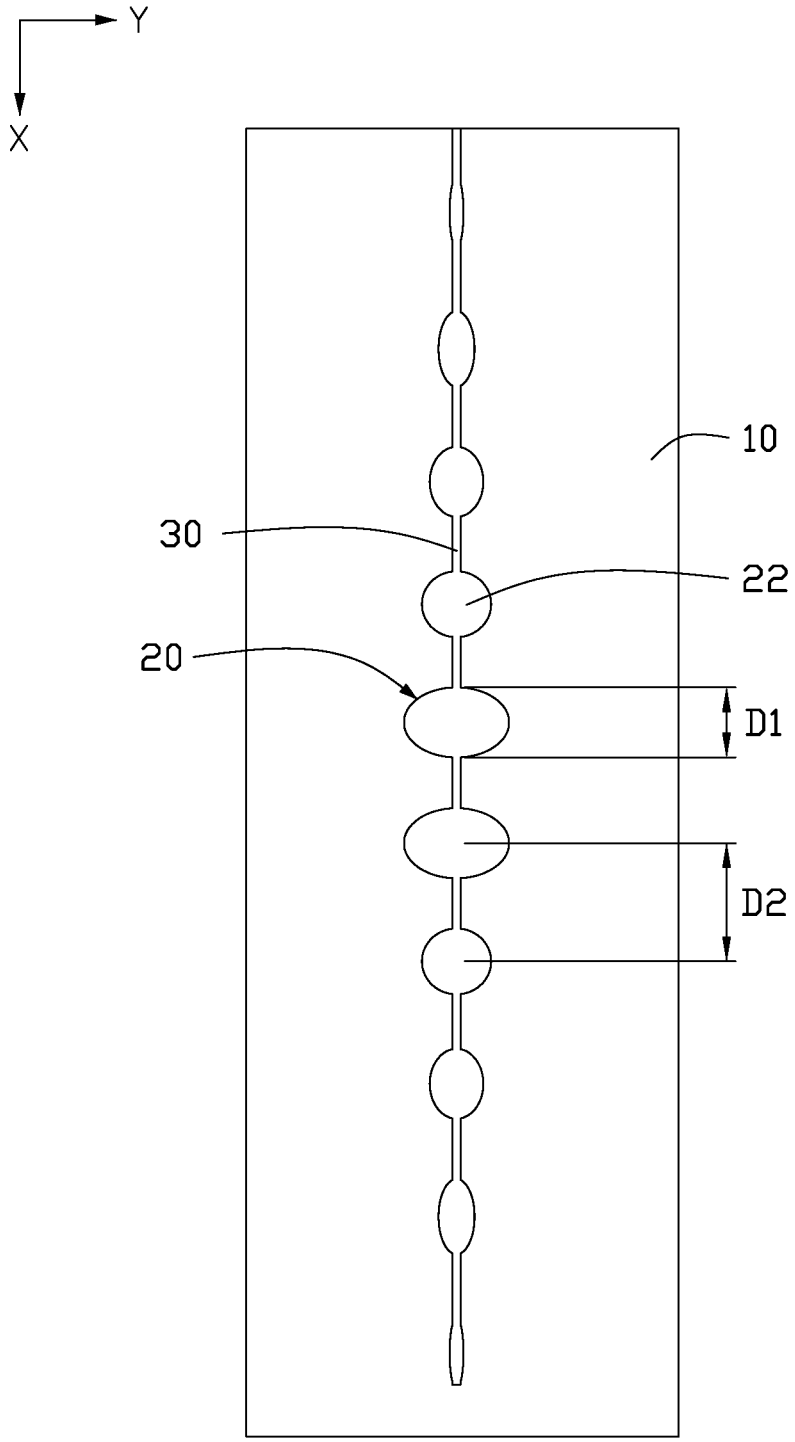
FIG. 2 is a planar view of the antenna structure of FIG. 1.

FIG. 1 shows an antenna structure 100 in the electronic device 200. FIG. 2 shows the electronic device 200 in a planar view. The antenna structure 100 emits and receives radio waves. The electronic device 200 can be a detection apparatus, such as a radar. The antenna structure 100 is a millimeter-wave radar antenna.

The electronic device 200 includes a dielectric slab 10. The electronic device 200 further includes other specified functional mechanical structures, electronic elements, modules, and software (not shown).

The dielectric slab 10 is a printed circuit board. The dielectric slab 10 is made of dielectric material, such as FR4 glass-reinforced epoxy laminate material.

Figure 3:
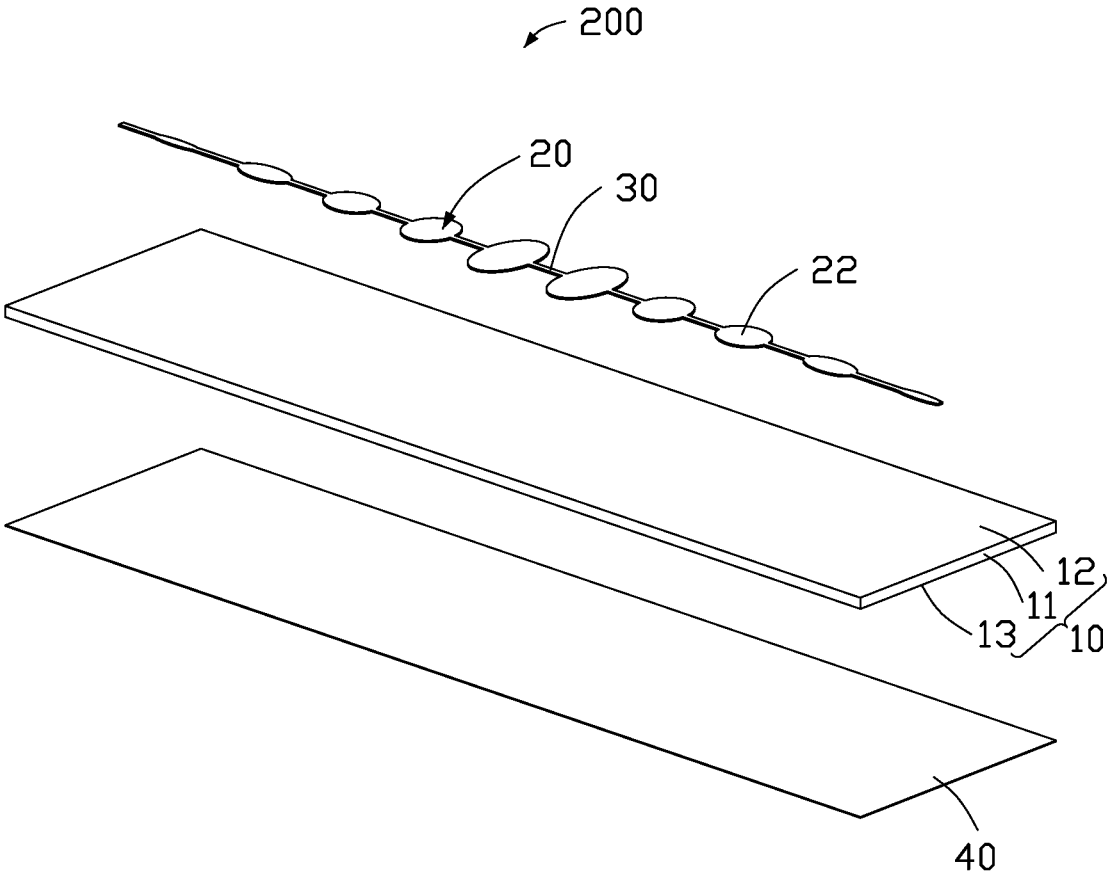
FIG. 3 is an exploded view of the antenna structure of FIG. 1.

FIGS. 1 and 3 illustrate the dielectric slab 10 including a side wall 11, a first surface 12, and a second surface 13 opposite to the first surface 12. The side wall 11 connects the first surface 12 and the second surface 13. The side wall 11 includes two opposite first walls 111 and two opposite second walls 112. The dielectric slab 10 supports the antenna structure 100.

In one embodiment, the dielectric slab 10 is a substantially rectangular shape. A width of the dielectric slab 10 is parallel with a Y axis, and a length of the dielectric slab 10 is parallel with an X axis. The first walls 111 are extended along the Y axis, and the second walls 112 are extended along the X axis.

The antenna structure 100 includes a radiating element 20. In one embodiment, the radiating element 20 includes N radiating units 22. N is an integer larger than 1. In one embodiment, N is 10. The radiating element 20 includes ten radiating units 22. In other embodiments, N is adjustable. All of the radiating units 22 are connected with each other by a feeder 30 to form the radiating element 20. The feeder 30 transmits a current signal to the radiating element 20, and the radiating element 20 emits a radar beam based on the current signal. The radiating units 22 are arranged along a first direction parallel with the X axis.

A length of the radiating unit 22 is parallel with the X axis, and a width of the radiating unit 22 is parallel with the Y axis. The feeder 30 is extended along the X axis, which is perpendicular to the Y axis. The length of the radiating unit 22 is parallel with the extending direction of the feeder 30, and the width of the radiating unit 22 is perpendicular to the extending direction of the feeder 30. The radiating units 22 have uniform length in an extending direction of the feeder 41, and width of each radiating unit 22 gradually decreases from a center of the radiating element 20 to the ends of the radiating element 20.

Each radiating unit 22 is substantially having the shape of an ellipse, and each of the radiating unit 22 has different width from each other. In other embodiments, the radiating unit 22 can be other shapes, such as rectangular.

In one embodiment, the radiating surface area of each radiating unit 22 is not same. The radiating surface areas of the radiating units 22 connected in series by one feeder 30 gradually decrease from a center to ends of the radiating element 20.

The two radiating units 22 provided in the center of the radiating element 20 have maximum radiating surface area. The radiating surface area of the remaining radiating units 22 provided along the X axis direction adjacent to the first wall 111 gradually decreases from the center. A ratio of length to width of the radiating units 22 gradually increases from the center to the first wall 111 and is maximum at most proximate to the first wall 111. A minimum value of the length to width ratio is found in two radiating units 22 provided at the center of the radiating element 20. The length to width ratio of the radiating unit 22 is proportionate to an impedance of the radiating unit 22, and the impedance of the radiating unit 22 is inversely proportionate to a radiating power of the radiating unit 22. Thus, a maximum radiating power is found in the two radiating units 22 in the center of the radiating element 20, and a minimum radiating power is found in the two radiating units 22 adjacent to the first wall 111. Thereby, a side-lobe level of the radiating element 20 is reduced.

FIG. 2 shows the radiating element 20 in a planar view. The length D1 of each radiating unit 22 does not change, which is 0.5λ. λ represents a wavelength of a current signal transmitted in the feeder 30 of the antenna structure 100.

A specified distance D2 of adjacent radiating units 22 is same, which is λ. In one embodiment, the λ is a fixed value.

In one embodiment, an end of the feeder 30 adjacent to one of the first walls 111 is electrically connected with a feeding portion (not shown) of the electronic device 200. The feeding portion feeds the current signal to each radiating unit 22 by the feeder 30, thus the antenna structure 100 emits a beam as radar.

FIG. 3 illustrates the antenna structure 100 further includes a ground region 40. The ground region 40 is spaced from the radiating element 20. The ground region 40 provides a ground voltage level.

In one embodiment, the radiating element 20 is disposed on the first surface 12. The ground region 40 is disposed on the second surface 13. The radiating units 22 and the feeder 30 are made of metal material. For example, the radiating units 22 are made of copper, and the feeder 30 is a microstrip line.

The ground region 40 is made of metal material, such as copper. The shape of the ground region 40 is same as the shape of the dielectric slab 10. The ground region 40 is substantially a rectangular shape. A width of the ground region 40 is equal to the width of the dielectric slab 10, and a length of the ground region 40 is equal to the length of the dielectric slab 10.

Figure 4:
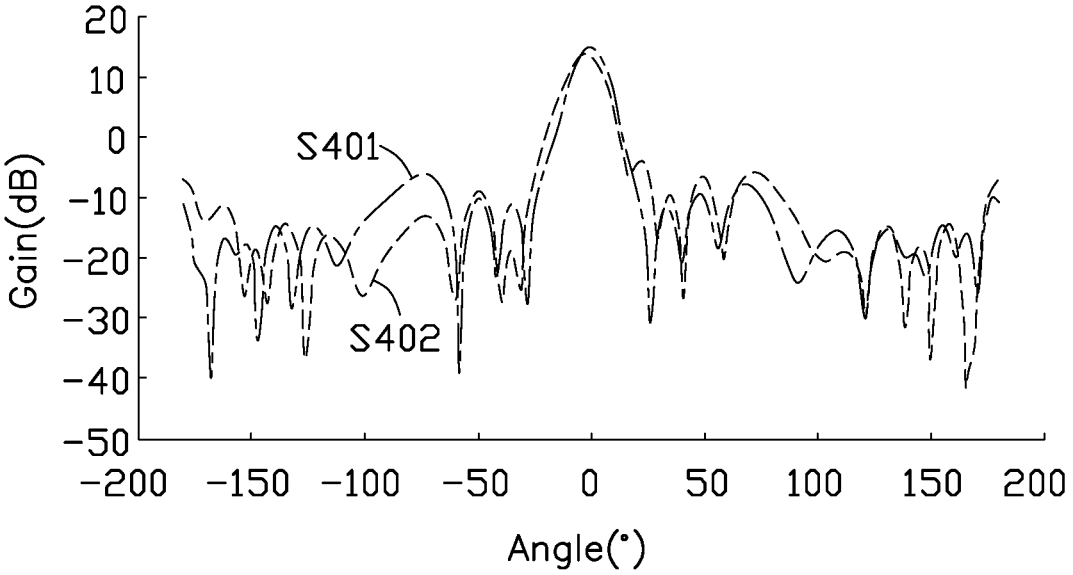
FIG. 4 shows waveform gain maps of the elliptic radiating unit and the rectangular radiating unit of FIG. 1.

FIG. 4 shows waveform gain maps of the antenna structure 100 with the elliptical radiating units 22 and the antenna structure 100 with the rectangular radiating units 22. A curve S401 represents the gain map of a circle with center at the antenna structure 100, which includes the elliptical radiating units 22. A curve S402 represents the gain map of a circle with center at the antenna structure 100, which includes the rectangular radiating units 22. Zero degrees represents a main radiating direction of the antenna structure 100. As shown in FIG. 4, the gain of the elliptical radiating unit 22 is larger than the gain of the rectangular radiating unit 22 by an amount of 0.9 dB.

Based on the structure of the antenna structure 100, the radiating units 22 are spaced apart by a specified distance. The lengths of each of the radiating units 22 are same, and the respective width of the radiating units 22 gradually decreases from the center to ends of the radiating element 20. Thus, a transmitting distance of the signals is improved, and the gain of the radiating element 20 is maintained.

While various and preferred embodiments have been described the disclosure is not limited thereto. On the contrary, various modifications and similar arrangements (as would be apparent to those skilled in the art) are also intended to be covered. Therefore, the scope of the appended claims should be accorded the broadest interpretation so as to encompass all such modifications and similar arrangements.

What is claimed is:

1. An antenna structure comprising:

a radiating element including a plurality of radiating units connecting by a feeder, the feeder transmits a current signal to the radiating element, and the radiating element emits a radar beam based on the current signal;

wherein the radiating units are spaced from each other in a predetermined distance;

wherein the radiating units have uniform length in an extending direction of the feeder and decreasing widths from a center of the radiating element to the ends of the radiating element;

wherein each radiating unit is substantially in the shape of an ellipse; the antenna structure further comprises a ground region; the ground region is spaced from the radiating element the ground region provides a ground voltage level to the radiating element the radiating element is overlapped with the ground region along a direction perpendicular to a surface of the radiating element.

2. The antenna structure of claim 1, wherein the length of the radiating unit is 0.5λ; λ represents a wavelength of a current signal transmitting in the feeder of the antenna structure.

3. The antenna structure of claim 1, wherein a width of the radiating unit is perpendicular to an extending direction of the feeder.

4. The antenna structure of claim 1, wherein the specified distance is λ; λ represents a wavelength of a current signal transmitting in the feeder of the antenna structure.

5. The antenna structure of claim 1, wherein the ground region and the radiating element are made of metal material.

6. An electronic device comprising:

a dielectric slab; and a radiating element disposing on the dielectric slab, said radiating element comprises a plurality of radiating units connecting by a feeder;

wherein the radiating units are spaced from each other in a predetermined distance;

wherein the radiating units have uniform length in an extending direction of the feeder and decreasing widths from a center of the radiating element to the ends of the radiating element;

wherein the antenna structure further comprises a ground region; the ground region is spaced from the radiating element the ground region provides a ground voltage level to the radiating element; the radiating element is overlapped with the ground region along a direction perpendicular to a surface of the radiating element.

7. The electronic device of claim 6, wherein the length of the radiating unit is 0.5λ; λ represents a wavelength of a current signal transmitting in the feeder of the antenna structure.

8. The electronic device of claim 6, wherein a width of the radiating unit is perpendicular to an extending direction of the feeder.

9. The electronic device of claim 6, wherein the specified distance is λ; λ represents a wavelength of a current signal transmitting in the feeder of the antenna structure.

10. The electronic device of claim 6, wherein the ground region and the radiating element are made of metal material.

11. The electronic device of claim 6, wherein the dielectric slab comprises a first surface and a second surface opposite to the first surface; the antenna structure is disposed on the first surface, and the ground region is disposed on the second surface.

12. The electronic device of claim 11, wherein a width of the ground region is equal to a width of the dielectric slab, and a length of the ground region is equal to a length of the dielectric slab.

* * * * *